United States Patent [19]

Soto

[11] Patent Number: 4,989,770

[45] Date of Patent: Feb. 5, 1991

[54] LOCKRING REMOVAL DEVICE

[76] Inventor: Manuel A. Soto, 1219 E. Hess Ave., Phoenix, Ariz. 85034

[21] Appl. No.: 478,360

[22] Filed: Feb. 12, 1990

[51] Int. Cl.[5] ..... B26F 3/00

[52] U.S. Cl. ..... 225/103; 7/138; 7/170; 81/488; 29/267; 225/93

[58] Field of Search ..... 29/267, 270, 278, 283, 29/283.5, 426.4, 426.5; 81/488; 7/138, 170; 83/909; 225/93, 103

[56] References Cited

U.S. PATENT DOCUMENTS

| | | | |
|---|---|---|---|
| 1,503,323 | 7/1924 | Heasley | 81/488 |
| 2,593,663 | 4/1952 | Fanelli | 225/93 |
| 2,711,109 | 6/1955 | Gillstrom | 225/93 |
| 2,736,088 | 2/1956 | Thygeson | 29/270 |
| 3,470,600 | 10/1969 | Hosbach | 29/243.57 |
| 3,619,887 | 11/1971 | McLaughlin | 29/207 |
| 3,629,883 | 12/1971 | Norman | 7/170 |

*Primary Examiner*—P. W. Echols
*Assistant Examiner*—David P. Bryant
*Attorney, Agent, or Firm*—Cahill, Sutton & Thomas

[57] ABSTRACT

A device for removing a ring closed and locked by a fastener containing a protruding fastener lock, the device includes a fastener engagement member having a wall and a floor which define a recess adapted to receive the fastener therein. Attached to an outer surface of the fastener engagement member is a lever member adapted to exert force on the fastener when the lever member is moved, thereby breaking the ring locked to the fastener.

9 Claims, 2 Drawing Sheets

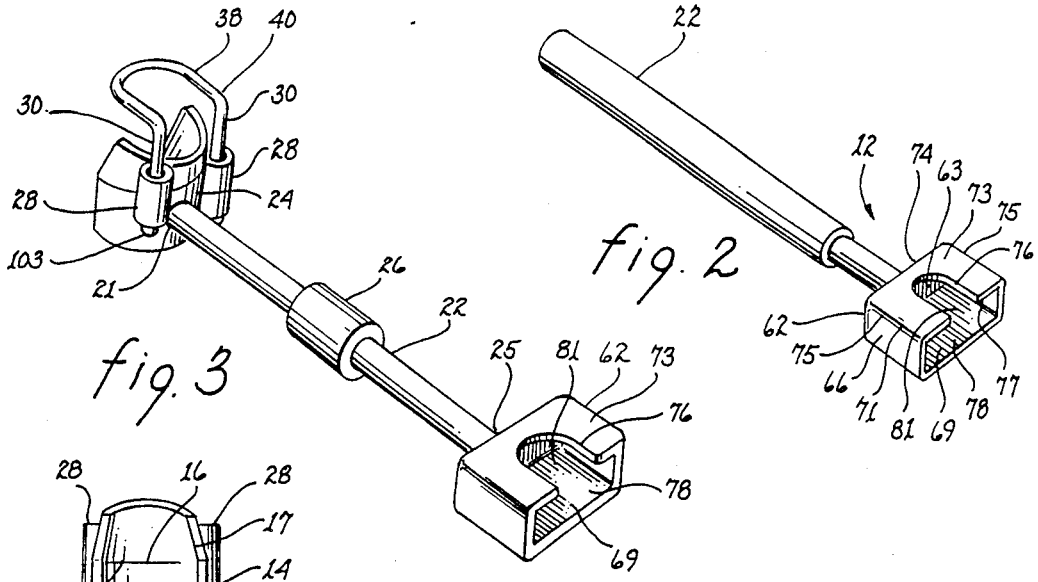
fig. 3
fig. 2
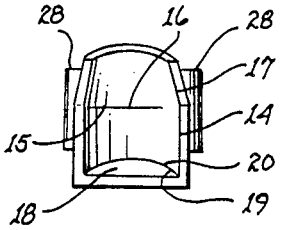
fig. 4
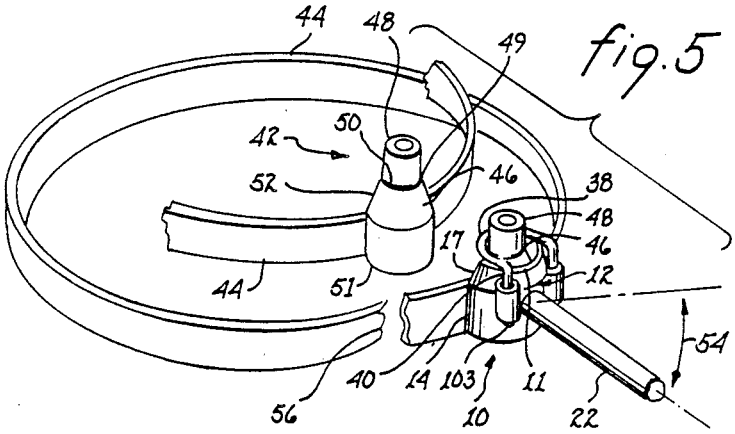
fig. 5
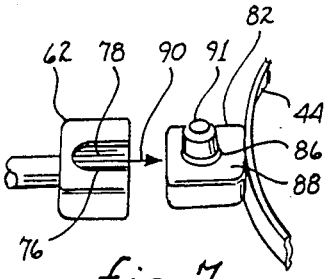
fig. 7
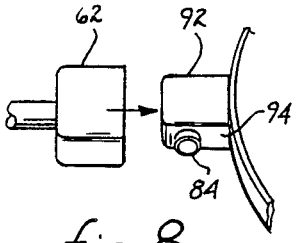
fig. 8
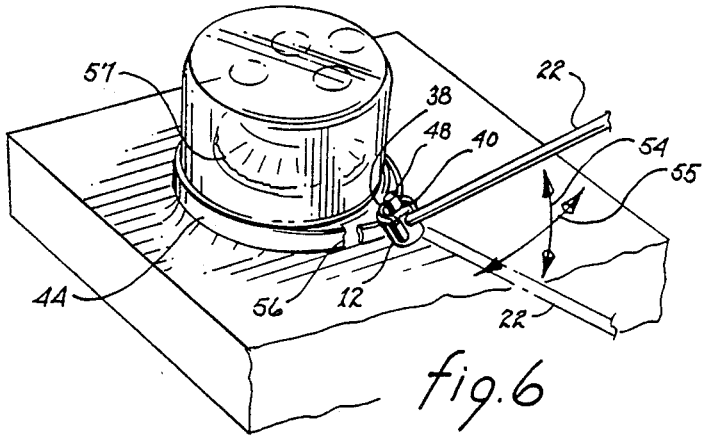
fig. 6

LOCKRING REMOVAL DEVICE

FIELD OF THE INVENTION

The invention relates to a device for removing lockrings, specifically, lockrings used to protect electric meters against tampering.

Electricity consumption is monitored by electric meters installed in the electric customers' residence or business. The meters are enclosed and sealed by glass covers so that meter readers from the electric utility company can quickly record the meter readings at regular intervals for billing purposes. To prevent vandalism or theft of electric energy by customers' tampering with the meters, the sealed glass covers are held in place by an open ended metal ring which surrounds the base of the glass covers; the ends of the ring are closed by a fastener and secured in place by a lock which fits into the fastener. The locking ring assembly is commonly known as a lockring.

The meter can be accessed for disconnecting or reconnecting power to the customer by inserting a key into the lock, removing the lock from the fastener, opening the ring, lifting the glass-covered meter away from the meter socket, and turning the power on or off by manipulating meter jaw terminals in the back of the meter. However, customers or vandals who tamper with the meter often damage the lock and/or fastener to the extent that the key will no longer work. Without a key, and because of the proximity of the glass cover, utility company workers have difficulty in safely removing the lockring in order to replace the vandalized meter.

At present there does not appear to be any device which can safely and easily remove electric meter lockrings; references found in the patent literature relate to tools which remove completely different fasteners. For example, U.S. Pat. No. 2,736,088 to Thygeson discloses a device to remove wall panel snap strips. U.S. Pat. No. 3,470,600 to Hosbach discloses a tool to remove or install horseshoe shaped lockrings used for retaining a shaft within a bore, such as, for example, the shaft and lockring used to mount the parking brake actuating lever to the brake shoe on automobiles. The Hosbach tool is intended to be used to maneuver lockrings without slipping or damaging the lockring. Finally, U.S. Pat. No. 3,619,887 to McLaughlin discloses a tool for removing a cylinder from a door lock, specifically, door knob locks or dead bolt locks.

SUMMARY OF THE INVENTION

Briefly described, and in accordance with one embodiment of the invention, the invention provides a device for removing a ring closed and locked by a fastener containing a protruding fastener lock. The device includes a fastener engagement member having a wall and a floor which define a recess adapted to receive the fastener therein. Attached to an outer surface of the fastener engagement member is a lever member adapted to exert force on the fastener when the lever member is moved, thereby breaking the ring locked to the fastener.

In a preferred embodiment of the present invention, the lever member is a handle having a first end attached to a first fastener engagement member comprising a semicylindrical member defining a recess adapted to snugly receive a lower section of the fastener therein. A semicircular floor is connected to a bottom edge of the semicylindrical member; connected to a top edge of the semicylindrical member is an inwardly sloping wall defining a recess adapted to snugly receive an upper section of the fastener therein. The first end of the handle is connected to an outer surface of the semicylindrical member. Connected to the second end of the handle is a second fastener enclosure member comprising an open box member defining a rectangular recess adapted to receive a rectangular fastener therein; the open box member has a rectangular rear wall perpendicular and connected on opposing side edges to respective side edges of a pair of opposing rectangular side walls. The bottom edges of the rectangular rear and side walls are connected to respective rear and side edges of a rectangular floor. The open box member further includes a top face connected on its rear and side edges to respective top edges of the rear and side walls. The top face has a U-shape orifice extending rearwardly from a leading edge. The second end of the handle is connected to an outer surface of the rear wall.

It is an object of the present invention to provide a device for safe removal of electric meter lockrings.

It is another object of the present invention to provide an inexpensive and uncomplicated device for removing electric meter lockrings.

Other objects, advantages and features of the present invention will become apparent from the following specification when taken in conjunction with the accompanying drawings.

BRIEF DESCRIPTION OF THE DRAWINGS

FIG. 2 is a perspective view of a fourth embodiment of a lockring removal device.

FIG. 3 is a perspective view of a fifth embodiment of a lockring removal device.

FIG. 4 is a sectional view taken on line 4—4 of FIG. 1*a*.

FIG. 5 includes a perspective view of a portion of a ring and one type of lockring fastener, and a perspective view of the application of the lockring removal device shown in FIG. 1*a* to the lockring fastener.

FIG. 6 is a perspective view of the lockring removal device shown in FIG. 1*a*, removing the lockring from an electric meter.

FIG. 7 is a perspective view of the application of the lockring removal device illustrated in FIG. 2 to a second type of lockring fastener.

FIG. 8 is a perspective view of the lockring removal device illustrated in FIG. 2 to a third type of lockring fastener.

DESCRIPTION OF THE PREFERRED EMBODIMENTS

Figure 1A:
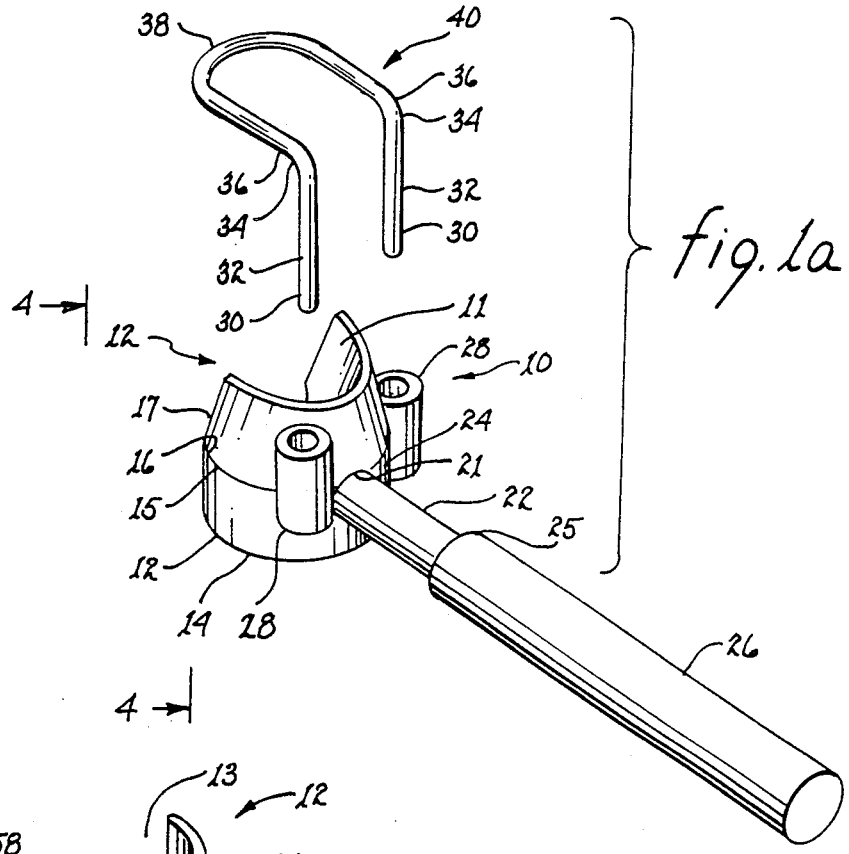
FIG. 1*a* is a perspective view of a first embodiment of a lockring removal device of the present invention.

Several embodiments of the lockring removal device of the present invention are illustrated in FIGS. 1*a*–1*d* and FIGS. 2–4. Referring to the first preferred embodiment illustrated in FIGS. 1*a* and 4, lockring removal device 10 includes a fastener engagement member 12 having a semicylindrical side wall 14 connected on its top edges 15 to bottom edge 16 of an inwardly sloping wall 17; a semicircular floor 18 is perpendicular to and connected at floor edge 19 to bottom edge 20 of the semicylindrical side wall. Semicylindrical side wall 14, inwardly sloping top wall 17, and semicylindrical floor 18 define a recess 11, which is adapted to receive therein a ring fastener having a compatible shape, such as ring fastener 46 of FIG. 5.

A first end 21 of a lever member or handle 22 is connected to semicylindrical side wall outer face 24. The handle and engagement member 12 can be constructed from a sturdy non-corroding metal such as stainless steel. Preferably, a second end 25 of handle 22 will include a gripping portion 26 constructed from a non-conducting material such as heavy plastic or fiberglass so that a worker holding the gripping portion will be protected against electrical shock if he inadvertently touches an energized part of the meter with the metal fastener engagement member 12.

A pair of upright, parallel tubes 28 are attached lengthwise to outer face 24 on opposing sides of handle 22. Each tube 28 is adapted to receive a first end 30 of one of a pair of legs 32; second ends 34 of the legs are respectively connected to opposing ends 36 of a u-shaped member 38 which is approximately perpendicular to the legs. The combination of legs 32 and u-shaped member 38 comprise fastener lock retaining clip 40. Alternatively, outer face 24 may have only a single parallel tube 28 attached to it, in which case the single tube would receive a first end 30 of a single leg 32, the second end 34 of the leg being connected to a u-shaped member 38.

FIGS. 5 and 6 illustrate lockring removal device 10 of FIG. 1*a* in operation; to keep the worker from being cut by breaking glass, it is preferable to tape glass cover 41, break it and remove the glass before using the device. A portion of a lockring 42 is shown in FIG. 5; ring 44, made from a heat tempered metal, is closed by means of sturdy metal ring fastener 46, and locked by means of fastener lock 48 located in opening 49 of fastener top 50. The fastener engagement member 12 of FIG. 1*a* closely approximates the shape of ring fastener 46, which has a cylindrical base 51 similar in size and curvature to semicylindrical side wall 14, and an inwardly sloping top section 52 similar in size and slope to inwardly sloping wall 17. Therefore, as shown in FIG. 5, ring fastener 46 fits snugly within recess 11, defined by fastening engagement member 12; u-shaped member 38 of fastener lock retaining clip 40 fits around fastener lock 48.

After fastener engagement member 12 and fastener retaining means 40 are in position, handle 22 is moved either up and down in the directions indicated by arrow 54, or from side to side in the directions indicated by arrow 55, until the leverage exerted by the handle on ring fastener 46 locked to ring 44 causes the ring to break, as indicated by crack 56; the lock retaining clip keeps the ring fastener in place inside the fastener engagement member while the handle is maneuvered. After ring 44 breaks, the broken ring can be removed so that the meter (indicated generally at reference numeral 57 in FIG. 6) can be replaced, and a new lockring installed.

Figure 1B:
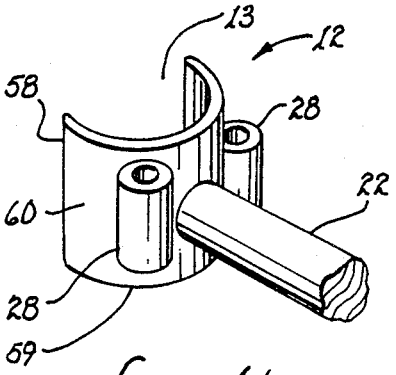
FIG. 1*b* is a perspective view of a second embodiment of a lockring removal device.

FIG. 1*b* illustrates a second embodiment of lockring removal device 10 wherein fastener engagement member 12 comprises a semicylindrical member 58 connected at its bottom edge 59 to a semicircular floor (not shown) essentially identical to the semicircular floor 18 illustrated in FIG. 4 the semicylindrical member and semicircular floor define a semicylindrical recess 13 adapted to receive therein a ring fastener 46 (illustrated in FIG. 5), or a cylindrical ring fastener (not shown). Handle 22 and parallel tubes 28 are attached to semicylindrical member outer face 60; the handle and parallel tubes are as described above with respect to FIG. 1*a*. The second embodiment also includes the fastener lock retaining clip 40 described above.

Figure 1C:
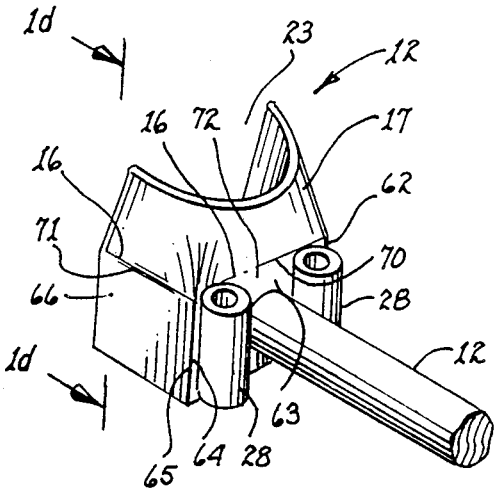
FIG 1*c* is a perspective view of a third embodiment of a lockring removal device.
Figure 1D:
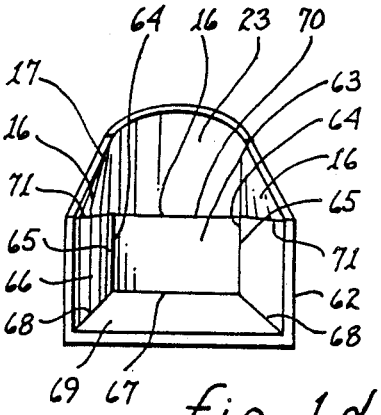
FIG. 1*d* is a sectional view taken on line 1*d*—1*d* of FIG. 1*c*.

In the third embodiment illustrated in FIGS. 1*c* and 1*d*, fastener engagement member 12 comprises an open box member 62 having a rectangular rear wall 63 perpendicular and connected on opposing side edges 64 to respective side edges 65 of a pair of opposing rectangular side walls 66; rear wall bottom edge 67 and opposing side wall bottom edges 68 are connected to respective rear and side edges of a rectangular floor 69. Rear wall top edge 70 and opposing side wall top edges 71 are connected to bottom edge 16 of inwardly sloping wall 17; the inwardly sloping wall is as described above with respect to the first preferred embodiment. Handle 22 and parallel tubes 28 are attached to rectangular rear wall outer face 72. The third embodiment also includes the fastener lock retaining clip 40 described above. Open box member 62, inwardly sloping wall 17, and rectangular floor 69 define an irregular recess 23 which is adapted to receive therein a ring fastener having a compatible shape, such as ring fastener 46 (illustrated in FIG. 5), or rectangular or cylindrical ring fasteners (not shown).

In the fourth embodiment, illustrated in FIG. 2, fastener engagement member 12 comprises an open box member 62 similar to that described above with respect to the third embodiment (FIG. 1*c*), but having a flat top face 73 in place of inwardly sloping wall 17. Top face 73 is respectively connected on its rear edge 74 and opposing side edges 75 to rear wall top edge 70 and side wall top edges 71; a u-shaped orifice 76 extends rearwardly from leading edge 77 of the top face. Therefore, opposite rear wall 63 is a rectangular recess entrance 78 defined by top face leading edge 77, leading edges 79 of opposing side walls 66, and rectangular floor leading edge 80; the rectangular recess 81 is adapted to receive therein a rectangular ring fastener such as that illustrated by reference numeral 82 in FIG. 7, or a rectangular side locking ring fastener 92 (illustrated in FIG. 8). A handle 22, substantially the same as described above with respect to FIGS. 1*a*–1*c*, is attached to rectangular rear wall outer face 72 (illustrated in FIG. 1*c*).

FIGS. 7 and 8 illustrate the lockring removal device of FIG. 2 in operation. As with the lockring removal device illustrated in FIGS. 5 and 6, it is preferred to tape the glass cover, break it and remove the glass before using the device. FIG. 7 shows rectangular metal ring fastener 82 attached to ring 44; rectangular fastener lock 91 is positioned in opening 86 located in the top 88 of the fastener. Open box member 62 closely approximates the shape of rectangular ring fastener 82. To break ring 44, open box member 62 is positioned over rectangular ring fastener 82, so as to substantially enclose it; rectangular fastener lock 91 is accommodated by u-shaped orifice 76. After rectangular ring fastener 82 is in place within open box member 62, handle 22 is moved up and down, or from side to side, as described above with respect to FIG. 6, until the leverage exerted by the handle on the rectangular ring fastener locked to ring 44 causes the ring to break. Top face 73 keeps rectangular ring fastener 82 in place inside open box member 62 when handle 22 is maneuvered.

FIG. 8 shows rectangular side locking ring fastener 92, which is similar in shape to rectangular ring fastener 82; however, in the side locking ring fastener, rectangular fastener lock 84 is located on a side face 94 rather than the top 88. Therefore, as shown in FIG. 8, both side locking ring fastener 92 and its associated rectangular fastener lock 84 are enclosed within rectangular recess 81, defined by open box member 62. The breaking of ring 44 by levering handle 22 against side locking ring fastener 92 enclosed within open box member 62 is as described above with respect to FIGS. 6 and 7.

The fifth embodiment, illustrated in FIG. 3, is a lockring removal device wherein the first end 21 of handle 22 is attached to the lockring removal device illustrated in FIG. 1*a* (that is, the first embodiment, described above), and the second end 25 of the handle is attached to the lockring removal device illustrated in FIG. 2 (that is, the fourth embodiment, described above). Retaining bolts 103 have been added to the first ends 30 of legs 32 to ensure that fastener lock retaining clip 40 remains in place inside tubes 28. A non-conducting gripping portion 26 is located between the first and second ends of handle 22.

The fifth embodiment is extremely practical because an electrical worker need only carry one tool to replace electric meters; if the meter is closed and locked by a ring fastener such as that described in FIG. 5 or 6, the worker can use the lockring removal device connected to handle first end 21. If an adjacent meter requiring replacement is closed and locked by a rectangular ring fastener such as is described in FIG. 7 or 8, the worker need only reverse the tool and use the lockring removal device connected to handle second end 25. Therefore, no matter which type of ring fastener confronts the worker at a given electric meter, one or the other ends of the fifth embodiment can be used to remove the lockring, thereby conserving valuable time which would have been wasted if the worker had had to return to his truck for a different tool.

It is to be understood that the present invention is not limited to the particular construction and arrangement of parts disclosed and illustrated herein, but embraces all such modified forms thereof which are within the scope of the following claims.

I claim:

1. A device for removing a ring closed and locked by a fastener containing a protruding fastener lock, the device comprising:

a. a fastener engagement member having a wall and a floor which define a recess adapted to receive the fastener therein; and b. a lever member having a first end attached to an outer surface of the fastener engagement member, the lever member adapted to exert force on the fastener when the lever member is moved, thereby breaking the ring locked to the fastener.

2. The device of claim 1, further including means for retaining the fastener in position inside the fastener engagement member recess when the lever member is moved.

3. The device of claim 2, wherein the fastener engagement member comprises a semicylindrical member defining a recess adapted to snugly receive the fastener; a semicircular floor connected to a bottom edge of the semicylindrical member; and wherein the fastener retaining means comprises an upright tube attached lengthwise to the outer surface of the semicylindrical member adjacent the lever member; and a clip having a first end adapted to fit into the tube and a second end adapted to engage the fastener lock so as to hold the fastener in position inside the semicylindrical member when the lever member is moved.

4. The device of claim 3, further including an inwardly sloping wall having a bottom edge equal in length and connected to a top edge of the semicylindrical member, the inwardly sloping wall adapted to snugly receive an upper section of the fastener.

5. The device of claim 2, wherein the fastener engagement member comprises an open box member having a rectangular rear wall perpendicular and connected on opposing side edges to respective side edges of a pair of opposing rectangular side walls, wherein bottom edges of the rectangular rear and side walls are connected to respective rear and side edges of a rectangular floor; an inwardly sloping wall having a bottom edge equal in length and connected to top edges of the rear and side walls; wherein the lever member first end is attached to an outer surface of the rear wall; and wherein the fastener retaining means comprises an upright tube attached lengthwise to the rear wall outer surface adjacent the lever member; and a clip having a first end adapted to fit into the tube and a second end adapted to engage the fastener lock so as to hold the fastener in position inside the open box member when the lever member is moved.

6. The device of claim 1, wherein the fastener engagement member comprises an open box member defining a rectangular recess adapted to receive a rectangular fastener therein, the open box member having a rectangular rear wall perpendicular and connected on opposing side edges to respective side edges of a pair of opposing rectangular side walls, wherein bottom edges of the rectangular rear and side walls are connected to respective rear and side edges of a rectangular floor, the open box member further including a top face connected on its rear and side edges to respective top edges of the rear and side walls, the top face having a U-shaped orifice extending rearwardly from a leading edge; and wherein the lever member is attached to an outer surface of the rear wall.

7. A device for removing a ring closed and locked by a fastener containing a protruding fastener lock, the device comprising:

a. a handle having first and second ends;

b. a first fastener engagement member comprising a semicylindrical member defining a recess adapted to snugly receive a lower section of the fastener therein; a semicircular floor connected to a bottom edge of the semicylindrical member; an inwardly sloping wall having a bottom edge equal in length and connected to a top edge of the semicylindrical member, the inwardly sloping wall defining a recess adapted to snugly receive an upper section of the fastener therein, wherein the first end of the handle is connected to an outer surface of the semicylindrical member; and c. a second fastener enclosure member comprising an open box member defining a rectangular recess adapted to receive a rectangular fastener therein, the open box member having a rectangular rear wall perpendicular and connected on opposing side edges to respective side edges of a pair of opposing rectangular side walls, wherein bottom edges of the rectangular rear and side walls are connected to respective rear and side edges of a rectangular floor, the open box member further including a top face connected on its rear and side edges to respective top edges of the rear and side walls, the top face having a U-shape orifice extending rearwardly from a leading edge, wherein the second end of the handle is connected to an outer surface of the rear wall.

8. The device of claim 7, further comprising first and second upright parallel tubes attached lengthwise to the outer surface of the semicylindrical member on opposing sides of the first end of the handle, and a retaining clip having upright first and second legs each having a lower end adapted to be received in the first and second parallel tubes, respectively, each leg further having an upper end attached to respective opposing ends of a U-shaped member which is perpendicular to the legs, the U-shaped member adapted to engage the protruding lock.

9. The device of claim 8, wherein the first and second handle ends and the first and second fastener engagement members are made from stainless steel, and wherein the handle includes a gripping portion made from a nonconducting material and positioned between the first and second ends.

* * * * *